US005901115A

United States Patent [19]

Katzmann et al.

[11] Patent Number: 5,901,115

[45] Date of Patent: May 4, 1999

[54] ANALOG RADIO CLOCK WITH TIME ZONE CONVERSION

[75] Inventors: Klaus Katzmann, Ruhla; Peter Wahl, Tuttlingen, both of Germany

[73] Assignee: Helmut Hechinger GmbH & Co., Germany

[21] Appl. No.: 08/719,356

[22] Filed: Sep. 25, 1996

[30] Foreign Application Priority Data

Apr. 18, 1996 [DE] Germany ..... 195 15 150

[51] Int. Cl.[6] ..... G04B 19/22; G04C 11/02

[52] U.S. Cl. ..... 368/21; 368/47

[58] Field of Search ..... 368/10, 21–22, 368/46, 47

[56] References Cited

U.S. PATENT DOCUMENTS

| | | | |
|---|---|---|---|
| 3,279,165 | 10/1966 | Burg | 368/21 |
| 3,653,204 | 4/1972 | Miwa | 368/22 |
| 3,822,545 | 7/1974 | Catto et al. | 368/22 |
| 4,117,661 | 10/1978 | Bryant, Jr. | 58/24 |
| 4,204,398 | 5/1980 | Lemelson | 368/47 |
| 4,287,597 | 9/1981 | Paynter et al. | 368/47 |
| 4,582,434 | 4/1986 | Plangger et al. | 368/47 |
| 5,077,706 | 12/1991 | Ganter | 368/47 |
| 5,408,445 | 4/1995 | Allgaier et al. | 368/47 |

*Primary Examiner*—Vit Miska
*Attorney, Agent, or Firm*—Pendorf & Cutliff

[57] ABSTRACT

For time zone conversion an analog radio clock is provided with a switch device (31), preferably a rotary switch, through which an hour correction value is continuously provided. The UTC-Time received from a time signal transmitter is corrected corresponding to this hour value in a differential establishing step (33). Additionally the analog radio clock is provided with the possibility, to decode whether the time signal transmitter transmitted information is at that instant in a summer or winter time period. Insofar as summer time is decoded, the correction value from the switch device (31) is automatically increased by a value of 1. The output signal from the differential establishing step (33) is employed for step control of the analog radio clock, which thus automatically indicates the instantaneous correct local time upon corresponding setting of the switch device (31).

4 Claims, 3 Drawing Sheets

ANALOG RADIO CLOCK WITH TIME ZONE CONVERSION

BACKGROUND OF THE INVENTION

1. Field of the Invention

The invention concerns an analog radio clock with a receiver and decoder assembly for receiving and decoding a time message transmitted by a time signal transmitter, including an adjustment device by means of which the indicator or display of the radio clock can be adjusted or set to a clock time in accordance with the decoded time message, and including an hour correction device, by means of which the clock time received from the time signal transmitter is adjustable in hourly increments via a manually operated switch assembly, with which an hour correction value is subtracted from the received clock time.

2. Description of the Related Art

This type of radio clock having a time zone conversion possibility has already been known. For example, in DE 42 19 257 A1 a radio clock with an analog indicator mechanism is described. The radio clock is suitable for receiving time messages which are transmitted by a time signal transmitter. For this the radio clock makes use of a receiver and decoder assembly, through which the time message sent by the time signal transmitter can be decoded. In accordance with the decoded clock time, the indicator or display of the analog clock is adjusted. For time zone conversion this known radio clock employs a switch mechanism external of the housing, preferably two push button switches. Upon manipulation of one of the two push button switches, the content of a summation register is increased or decreased. The content of the summation register corresponds to an hour correction value, and the actual content of the hour information of the received time message is increased or decreased in accordance therewith.

For error free time zone selection and programming of the appropriate time zone for the clock time displayed at the moment, the known radio clock has an electro-optic display with cartographic representation of adjacent time zones. The electro-optic display is coupled to the switch for time zone conversion, so that the user of the radio clock can determine without difficulty, to which time zone the instantaneously exhibited time display of the indicator of the radio clock corresponds.

Problems with this type of known radio clock include on the one hand the relatively complex investment of technical resources necessary for the cartographic representation of adjacent time zones through the electro-optic medium. Beyond this the user is not able to determine, in the case of failure of the electro-optic indicator, to which time zone the instantaneously displayed clock time of the display corresponds.

A further problem with this known type of radio clock is comprised therein, that a normally UTC-time transmitting time message transmitter transmits a clock time, which is calibrated to world time that is, Greenwich Mean Time. If the radio clock as known from DE 42 19 257 A1 is employed in the USA, which is obviously intended to be the case since the example shows with the graphic indicator in the figure represents the four time zones of the United States of America, then in that case the push buttons must be exercised four times, in order to display the correct local time in the radio clock. If for example, the radio clock is employed in New York, then in that case as a result of the time displacement of minus 5 hours the push button must be operated 5 times, in order that a hour correction value of minus 5 is entered in the therein provided summation register. Should the owner of the radio clock stop over in San Francisco, then he must operate the push button 8 times, in order that the time displacement of minus 8 hours with respect to UTC-Time is entered in the radio clock. This manipulation is quite inconvenient.

A further problem occurs in this known radio clock when the time signal transmitter transmits as normal the UTC-Time, but at the location of the corresponding time zone however a daylight savings time is in effect. Even when with this known radio clock the correct time zone is entered by using the push buttons, a false display can result for the reason that the hour indicator of the radio clock is not advanced one hour to correspond to the appropriate summer time. If in this case the hour indicator is manipulated in order to set the correct summer time, then the result would be a false time zone indication.

This problem occurs particularly in the USA, since there the time signal sender routinely transmits UTC-Time as the time message and supplements the time message with status bits corresponding to the presence of a summer or winter time period. A direct adjustment of the hour indicator with the transmitted time message is not possible in the United States as a result of the various time zones.

From EP 0 372 432 B1 a further radio clock is known, which is provided with a time zone converter. However, in this case the therein described radio clock is a radio clock with digital indicator. The radio clock is provided with a manually operable hour selector, which provides an hour correction in the hour correction register by repeated operation of a push button or rotation of a rotary knob. The display of the digital radio clock indicates the hour correction value, so that the user of this radio clock knows the number of hours which at any point in time the displayed clock time differs from the clock time of the time signal sender. This radio clock operates on the precondition, that the summer or winter time-change be included directly in the hour information of the time display clock time.

A problem with this type of known radio clock is that these do not automatically adjust themselves to the correct local time when, for example, a battery is placed into the clock. In the case that a battery is installed, the hour correction register is set on the value of zero. As the display, the value transmitted by the time signal sender is simply displayed. The user of the clock must then, on the basis of his own clock, determine whether a deviation exists. In the case that a deviation exits, this time displacement or differential must be entered into the radio clock by means of the hour correction switch.

SUMMARY OF THE INVENTION

The present invention is concerned with the task of providing an analog radio clock, which sets itself automatically to the correct local time after insertion of a battery.

The analog radio clock according to the invention is comprised of a receiver and decoder assembly for receiving of time messages of a time signal transmitter, which transmits a time signal message corresponding to the actual UTC (UNIVERSAL TIME COORDINATED) time. Additionally the receiver and decoder assembly has access to a means to decode transmitted information regarding the momentary state as to summer time or winter time, which information is transmitted by the time signal transmitter independent of the UTC-Time. Further, an hour adjustment assembly provides, via a manual switch assembly external of the housing of the analog radio clock, an hour adjustment value in order to change the hour value of the radio clock. Therewith the hour indicator is continuously so set during operation of the analog radio clock, that it in all cases deviates from the hour which is transmitted by the time signal transmitter and this deviation corresponding exactly to the hour adjustment value manually inserted via the switch assembly. Additionally, the hour adjustment assembly is connected to the receiver and decoder assembly such that in the case of a decoded summer time signal the hour adjustment value input via the manual switch assembly can be increased by a value of plus 1.

This type of radio clock makes possible an automatic setting of the indicator or display upon the hour time which corresponds to the actual local time immediately after introduction of the electrical supply, for example, introduction of a suitable battery, insofar as the adjustment assembly is set upon the correct time zone prior to introduction of the battery or during the operation of the radio clock.

As a suitable adjustment or switch assembly there can for example be employed a rotary switch, which provides access to the analog clock from the outside through the back side of the housing and which displays various switch positions, which are inscribed in a suitable manner. Although it is possible in principal to select any type of inscription therefore, it is found to be preferable when the individual switch positions of the rotary switch are so indicated that the user knows immediately upon which time zone the clock is set. For use of the analog clock in the USA, for example, 4 switch positions of the rotary switch are provided, namely switch positions for Eastern Time, Central Time, Mountain Time and Pacific Time. Corresponding to the time displacement of these four time zones with respect to UTC-Time, upon positioning of the rotary switch upon Eastern Time there is within the decoder of the analog radio clock an hour correction value of minus 5, upon selection of Central Time a hour correction value of minus 6, upon selection of Mountain Time a hour correction value of minus 7 and upon selection of Pacific Time an hour correction value of minus 8 entered in the decoder. The output of the decoder is inserted into a differential providing step which serves to subtract the hour correction value from the instantaneously received UTC-Time, so that the adjustment assembly provides the analog radio clock, that is, the clock work, with a correct local time.

BRIEF DESCRIPTION OF THE DRAWINGS

Since the hour correction value is automatically increased by a value of 1 upon receipt of a summer time signal, the display of the analog radio clock itself is correct even in the case that the time in one of the above-mentioned time zones respectively switches at a particular point in time to summer time or as the case may be switches back from summer time to winter time.

A further development of the invention includes the modification that the decoder of the hour correction assembly is provided not only with a status bit signal for the instantaneous summer or winter time of the time signal sender, but rather that this decoder additionally is provided with information regarding the instantaneous UTC-Time. This is necessary so that even on the day of the conversion from summer time to winter time or as the case may be from winter time to summer time the correct display of the clock time is exhibited, even in the case that on this day the electricity supply to the clock is switched off or there was no reception.

Figure 1:
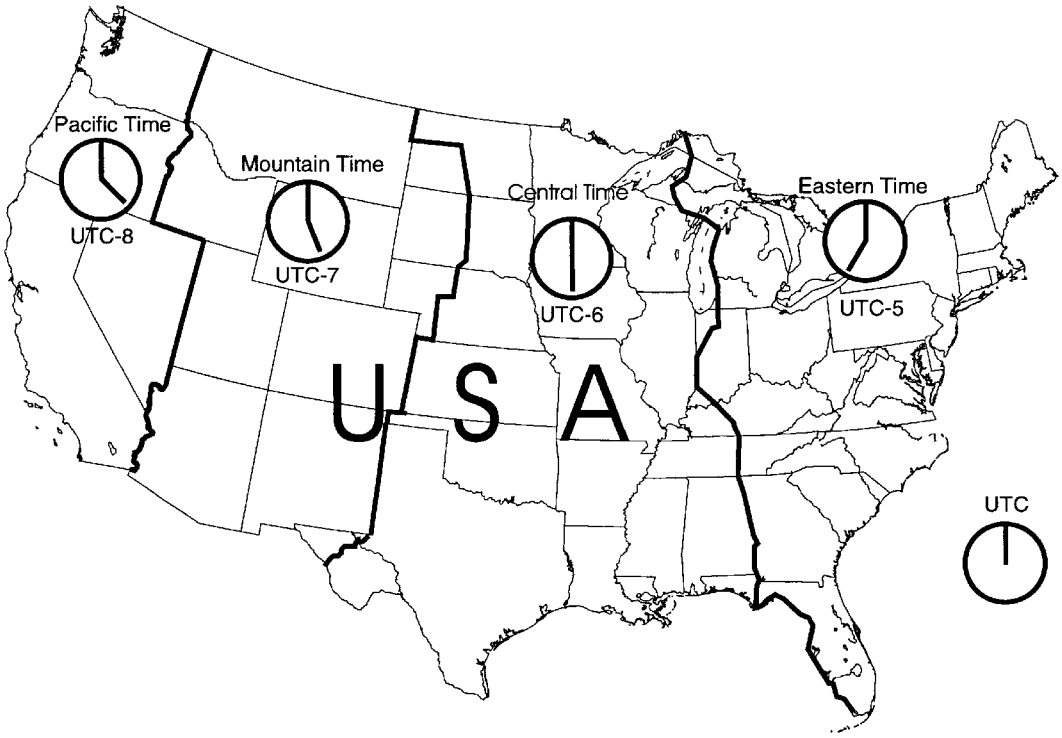

The invention will now be shown in greater detail by reference to an exemplary embodiment and three figures. There are shown:

FIG. 1: A cartographic view of the United States of America, in which the various time zones are indicated and the appropriate time displacements with respect to UTC-Time is indicated.

Figure 2:
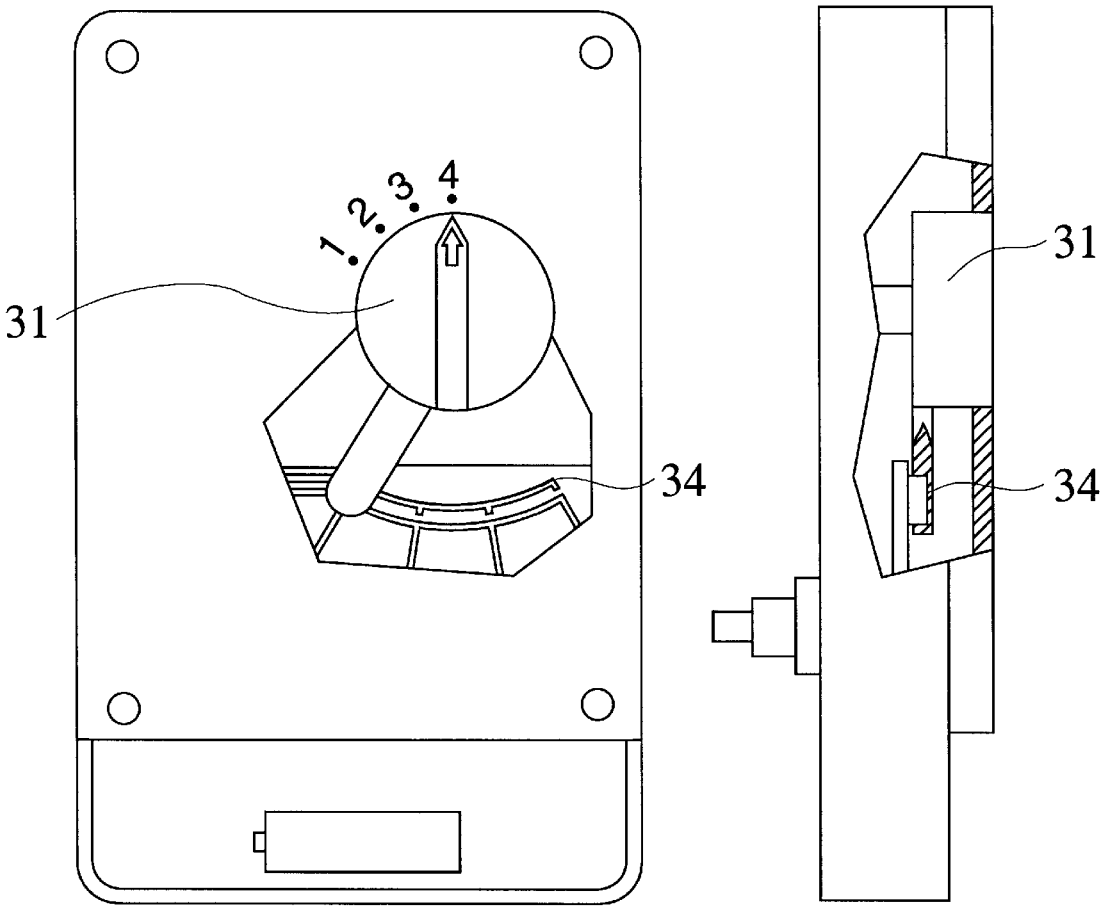

FIG. 2: The back view and a partially broken away side view of a housing, in which the analog radio clock according to the invention can be housed.

Figure 3:
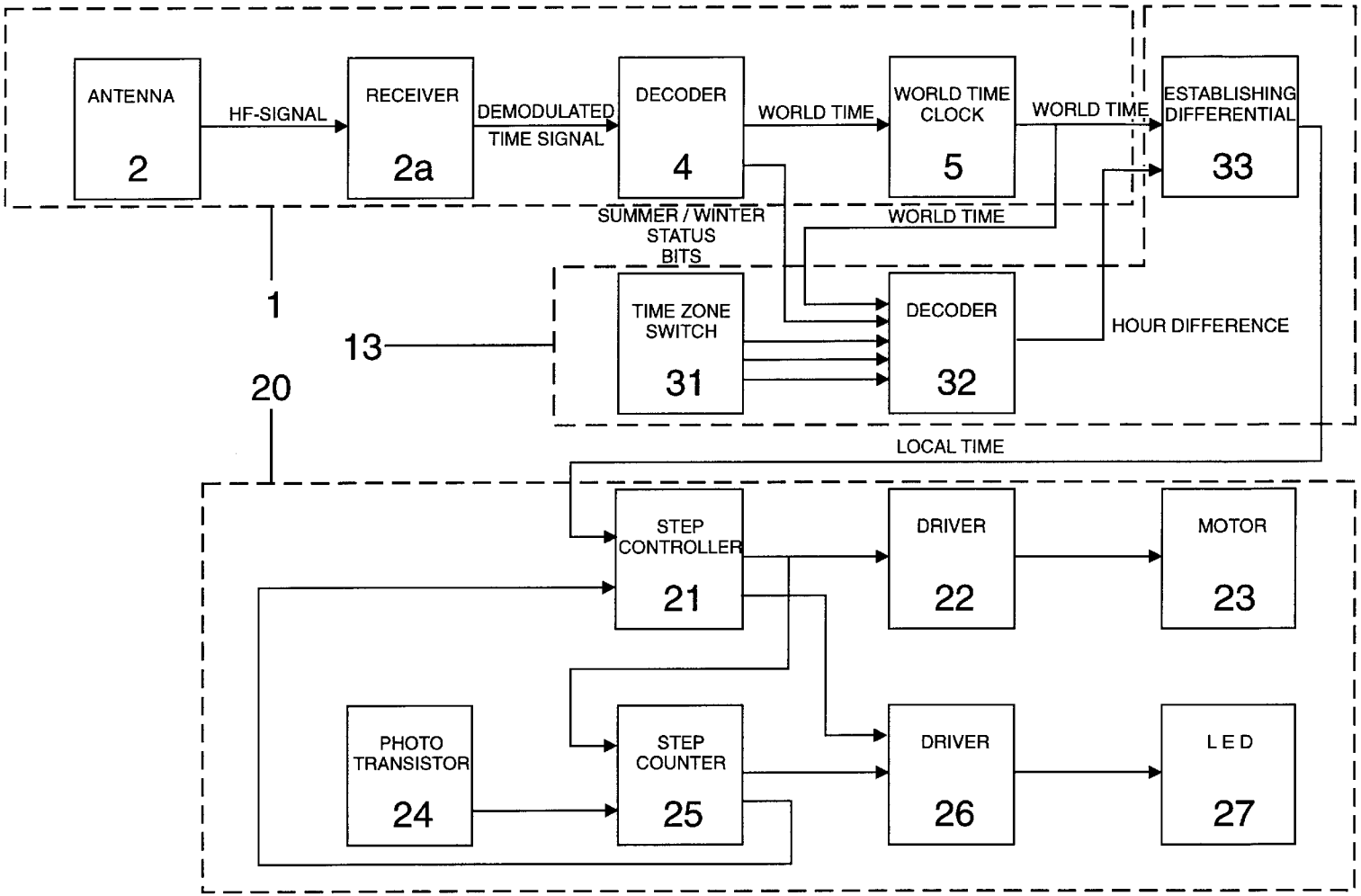

FIG. 3: One possible block circuit diagram of the analog radio clock according to the invention.

DETAILED DESCRIPTION OF THE INVENTION

The following is based upon the presumption, that the analog radio clock according to the invention is employed in an area of the United States of America. The analog time clock must thus have the ability to correctly indicate the respective correct local time upon operation in the various time zones and upon a change from one to another of these time zones.

For a better understanding of the invention, the various time zones of the United States of America are graphically represented in FIG. 1. The time displacement with respect to UTC-Time can be seen from the respective clocks shown in the time zones in FIG. 1. If the UTC-Time at that instant is 12:00 o'clock, then the following local times apply for the various time zones in the United States of America:

Eastern Time: 07:00, that is, minus 5 hours,

Central Time: 06:00, that is, minus 6 hours,

Mountain Time: 05:00, that is, minus 7 hours,

Pacific Time: 04:00, that is, minus 8 hours.

Further it is assumed in the following that a time signal transmitter is available which transmits a time message or as the case may be time messages which correspond to the UTC-Time.

In order to display the appropriate correct local time, the analog radio clock according to the invention is provided with a switch assembly, which makes it possible, that the above described hour adjustment is taken into consideration in the analog clock. One exemplary embodiment of such a switch assembly is a rotary switch, as shown for example in FIG. 2. The rotary switch as provided on the back side of the radio clock housing as indicated with reference numeral 31 and has access to switch positions which in this embodiment are indicated by the four numbers "1", "2", "3" and "4". The switch position "1" indicates for example Pacific Time, the switch position "2" indicates Mountain Time, the switch position "3", upon which the rotary switch 31 in the exemplary embodiment of FIG. 2 is presently resting, indicates Central Time and the switch position "4" indicates Eastern Time.

The rotary switch 31 is in electrical contact with the decoder 32 through a sliding contact 34 which, depending upon the above described switch position of the rotary switch 31, establishes an hour adjustment value, in order that this above discussed hour adjustment value be integrated with the received UTC-Time, and thereby ensure a correct local indication of the analog radio clock. Since it is a precondition that the time signal transmitter transmits a UTC signal, it is necessary, that for the employment of the radio clock in the USA, an hour correction value is continuously present at the output of the decoder 32, in order that the correct local time can be displayed.

In FIG. 3 a block diagram of a possible embodiment of the analog radio clock according to the invention is represented. The radio clock essentially includes a receiver and decoder assembly 1 for receiving and decoding a time message transmitted by the time signal transmitter. For this the receiver and decoder assembly 1 is provided with an antenna 2, through which an HF-signal can be received by the receiver 2*a*. At the output of the receiver a demodulated time signal can be read, which is conveyed to the decoder 4, on the output side of which a world time signal is readable. This world time signal can be displayed for example in a suitable display device 5, for example a digital display, for monitoring purposes. This type of monitoring display is however not a necessity. The World Time Signal is conveyed from the output of a receiver and decoder assembly 1 to a hour correction assembly 13. The hour correction assembly 13 has access to a time zone switch 31, which in the illustrative embodiment according to FIG. 2 is constructed as a rotary switch 31. The time zone switch is in communication with a decoder 32 via feed lines, at the output side of which an hour adjustment value is made available. This hour adjustment value is relayed to differential establishing step 33, which likewise receives the previously described World Time Signal. The decoder 32 additionally receives a status signal which indicates whether the summer time, the winter time or the conversion thereof is being carried out. The decoder 32 evaluates the status signal and adds, in the case that that the summer signal is transmitted as status signal, the value plus 1 to the hour correction value established from the time zone switch 31.

In the case that for example a two bit status signal, as conventional in the USA, is sent, so the results the bit sequence "11" summer time, the bit sequence "00" standard time or as the case may be winter time. The bit sequence "01" has the meaning that conversion is being made from the standard time to the summer time, while the bit sequence "10" has the meaning that the conversion is being made back from the summer time to the standard time.

The bit sequences "01" and "10" are only transmitted from the time signal transmitter on that day at which the conversion from summer time to winter time or as the case may be winter time to summer time is occurring.

In order that the analog time clock according to the invention automatically indicates the correct local time on the two days, during which the summer/winter time conversion is occurring, it is necessary to provide the decoder 32 of FIG. 3 also with the information regarding the actual UTC-Time. Since the decoder 32 simultaneously receives both the instantaneous UTC-Time, the hour correction value from the time zone switch 31 and the information, that on this day the summer/winter conversion is occurring, the decoder is without more in condition, at the instant of the summer/winter conversion, for example at 02:00 local time, to advance or retard the clock time one hour.

If for example the transition from winter time to summer time occurs at 01 April Sunday of a year, then the status signal at the exit of the decoder 4 of the receiver and decoder assembly 1 reads "10". When this time conversion should occur at 02:00 local time, this can be taken into consideration without more within the decoder 32, since the decoder 32 receives the instantaneous UTC-Time and an hour correction value through the time zone switch 31. In the decoder 32 there is therewith all the information available for the instantaneous local time in which the operator of the radio clock is located, insofar as the time zone switch 31 is switched to the appropriate time zone. Should the operator be for example be in New York, then the above described rotary switch 31 is switched to the position "4". This means, that within the decoder 32 an hour correction value of minus 5 is to be subtracted from the hour of the just received UTC-Time message. If the World Time shows 07:00 then this is shown as having the equivalent meaning of local time 02:00 if there is no change in the position of the rotary switch 31. On the basis of the status bit signal "10" the hour adjustment value within the decoder 21 is subsequently increased by 1 in the present illustrative embodiment, so that at the output of the decoder 32 not the indicated hour adjustment value of −5 from the time zone switch 31 but rather the summer time corrected hour adjustment value of −4 is provided. This corrected hour adjustment value is provided to the differential establishing step 33, which as a consequence thereof subtracts four hours from the World Time, and makes this available to the adjustment assembly for the display control of the clock work of the analog clock.

The positioning device 2*c* of the radio clock can be constructed in a known manner and employs for example a step controller 21 and a driver 22 for the driving of the motor 23. Beyond this the step control 21 is connected at the exit side with for example a further driver 26, which controls a LED indicator 27 of a reflex light shutter, which serves for detecting the position of the indicators.

Finally the step control 21 can at the exit side be connected with a step counter 25, which is communication with a photoelement of the reflex light shutter, for example a phototransitor 24. The output of the step counter 25 is coupled back to the step controller 21.

In summary it can be seen that the invention is based upon the assumption that a time signal transmitter always transmits UTC-Time. The wiring of the time zone switch 31 as well as the status bits of the radio clock signal, which describe the summer/winter time status, are provided to the decoder 32 of the hour correction assembly 13. At the output of the decoder 32 an hour differential is made available. The decoder 32 can as a result of the summer/winter time bits and the UTC-Time determine, whether the time conversion between summer and winter time is occurring at the moment, whether it remains in the time zone in interest yet in the future, or whether it has already occurred. The result is an hour correction value for UTC-Time, from which the local time can be calculated in a simple manner.

The step control always insures the occurrence of the motor steps, when the local time is greater than the indicator position as stored in the step counter. Further, the step controller in periodic time intervals switches on a reflex light shutter in addition to the LED 27, which serves for detection of the indicator position. The light received via the photoelement 24 serves, after decoding, for the actualization of the step counter.

What is claimed is:

1. Analog radio clock, said analog radio clock comprising:

a housing;

a receiver and decoder assembly (1) for receiving and decoding a UTC-Time time message transmitted by a time signal transmitter, including means for decoding information transmitted by the time signal sender regarding the current status as to summer time or winter time;

an analog indicator comprising motor-driven indicators for displaying a clock time;

an indicator positioning device (2), which corrects and positions the indicators of the radio clock upon clock time in accordance with the local time in accordance with the decoded time signal, such that said clock sets itself automatically to the correct local time after insertion of a battery in accordance with the selected time zone by the manual switch (31); and an hour correction device (3) via which the time signal received from the UTC-Time time message is continuously offset, wherein this time offset is adjustable in hour increments via a manual rotary switch (31) accessible from outside the housing of the analog radio clock, wherein the hour correction device (3) is connected with the receiver and decoder assembly (1), such that in the case of decoding a summer time signal the hour correction value input by the manual switch (31) is increased by one hour, wherein said housing includes indicia associated with Eastern time, Central time, Mountain time, and Pacific time corresponding to the positions of the manual switch (31).

2. Analog radio clock according to claim 1, wherein the decoder (32), in addition to the receiver and decoder assembly (1), receives a time signal for the instantaneous UTC-Time.

3. Analog radio clock according to claim 1, wherein an hour correction value is provided at the output of the decoder (32), and wherein this hour correction value is provided to the differential establishing step (33), and the output of the differential establishing step (33) is coupled with the step controller (21) of the position assembly (2) of the analog radio clock.

4. Analog radio clock according to claim 1, wherein the rotary switch (31) is provided on the back side of the housing of the analog radio clock and is movable to various positions each of which are respectively indicated with individual markings, wherein the markings correspond to various time zones.

* * * * *